US006474210B1

(12) United States Patent
Nel et al.

(10) Patent No.: US 6,474,210 B1
(45) Date of Patent: Nov. 5, 2002

(54) BAGEL SLICER

(76) Inventors: André Marcel Emil Nel, 3984 Washington Blvd. #305, Fremont, CA (US) 94538-3229; David Snelgrove, 901 Deyoung Rd., Greer, SC (US) 29651-7157

( * ) Notice: Subject to any disclaimer, the term of this patent is extended or adjusted under 35 U.S.C. 154(b) by 0 days.

(21) Appl. No.: 09/860,796

(22) Filed: May 18, 2001

(51) Int. Cl.[7] ..... A24C 5/12

(52) U.S. Cl. ..... 83/768; 83/465; 83/607; 83/932

(58) Field of Search ..... 83/932, 600, 607, 83/798, 51, 54, 594, 595, 596, 784; 30/93, 109, 111, 112, 279.2, 289

(56) References Cited

U.S. PATENT DOCUMENTS

| | | | | | |
|---|---|---|---|---|---|
| 5,301,577 | A | * | 4/1994 | Flisram | 241/292.1 |
| 5,591,072 | A | * | 1/1997 | Tweed et al. | 451/293 |
| 5,715,602 | A | * | 2/1998 | Hage | 30/111 |
| 5,974,668 | A | * | 11/1999 | Butzer | 30/110 |
| 5,983,505 | A | * | 11/1999 | Gibson | 30/279.2 |
| 6,006,640 | A | * | 12/1999 | Bastion | 30/286 |
| 6,186,038 | B1 | * | 2/2001 | Lastovich et al. | 269/54.5 |
| 6,216,346 | B1 | * | 4/2001 | Wechsler | 30/111 |
| 6,295,991 | B1 | * | 10/2001 | Emery | 131/248 |

* cited by examiner

*Primary Examiner*—Paul T. Sewell
(74) *Attorney, Agent, or Firm*—N Paul Friederichs; Angenehm Law Firm

(57) ABSTRACT

A slicing apparatus for slicing a food item having a flat bottomed base for placement upon a work surface; a bifurcated outer annulus attached to the base and extending perpendicularly upward from the base, the annulus having an arcuate slot formed on the peripheral centerline of the annulus; the annulus further having a first pair of diametric opposed knife attachment points formed on the inner surface of the annulus; an inner annulus located within the outer annulus and rotatable thereat, the inner annulus further having a second pair of diametrically opposed knife attachment points and an attached handle extending radially outward passing through the peripheral slot of the outer annulus; a left cover and a right cover, each cover having a convex circular outer surface and a concave circular inner surface, the periphery of the respective inner surfaces sized to matingly abut with the respective sides of the outer annulus, the covers further being pivotally attached to the base; an upper and a lower knife, each knife being arcuate in shape and having a cutting edge on the smaller diameter edge thereof, and further having a first end and a second end, each of the ends having an attachment point; each of the first ends being pivotally attached to a respective knife attachment point of the outer annulus and each of the second ends being pivotally attached to a respective knife attachment point of the inner annulus; whereby, movement of the handle through an arc rotates the inner annulus moving the knifes across the inner open part of the annuli and slices the food item.

13 Claims, 4 Drawing Sheets

BAGEL SLICER

BACKGROUND OF THE INVENTION

The invention relates to, generally, a food preparation item, and more particularly relates to a method and apparatus for slicing substantially circular food items such as bagels, muffins, donuts and the like. A number of machines and devices for slicing bagels, and the like have been disclosed in the prior art. These generally comprise holding jigs or receptacles where the food item is placed for slicing with a conventional knife.

Many of the bagel slicing machines may be suitable for use in a production environment, but, are too large or expensive to be suitable for in-home use. Additionally, many of these machines do not work very well, and are seldom used in the production environment except when a large number of bagels needs to be sliced quickly, for example, to satisfy a large sandwich order. The nonuse of these machines leads an observer to believe that the machines have some serious shortcomings such as difficulty in use and poor quality of the slicing cut.

The prior art also disclose the bagel or food item slicers intended for home use usually are a bagel holder with guides for guiding the user supplied conventional knife to slice the bagel in a conventional manner. While the guide type of slicer does make it much easier for a user to slice a bagel into two approximately equal pieces, frequently, the user has no choice as to the thickness of one of the pieces, and may have one large and one small piece. Some of the slicing guides allow selecting the slicing point with respect to the guide, but, generally, to change the slicing point involves movement of the guides, and is not easily done for one bagel. It is more suitable for moving the slicing point for example changing from bagels to English muffins. An additional shortcoming of the guide type of slicer is that a conventional knife is used and often the knife blade is exposed and there is the risk of the user being cut.

SUMMARY OF THE INVENTION

Briefly stated, the invention is a small portable apparatus for slicing bagels, english muffins, donuts, or other baked food items. The invention has an outer annulus enclosing a central cutting chamber for holding the food item and a pair of covers for retaining the food item centered in the cutting chamber. The covers are rounded plates pivotally attached to the base, and preferably held in a closed position. A pair of arcuate knives are pivotally attached to the inner surface of the annulus at one end, the second end of the knives are attached to an inner annular ring. The inner annular ring has an attached handle extending radially outward through the outer annulus. Moving the handle rotates the inner annulus which causes the knives to pivot through an arc cutting through the food item. The knives have both curved inner and a curved outer surface and are sized to fit adjacent the inner annulus. The inner curved surface is the cutting edged and is preferably sharpened serrated cutting edge.

The covers are approximately circular in shape having an extended attachment tab formed on and extending outwardly from the lower edge. The attachment tab extends downwardly to provide a point of attachment between the covers and the base.

The base of the bagel slicer is generally rectangular in shape and has a flattened bottom for placement on a conventional flat work surface. The covers are pivotally attached to the base.

DESCRIPTION OF THE PREFERRED EMBODIMENT

Figure 1:
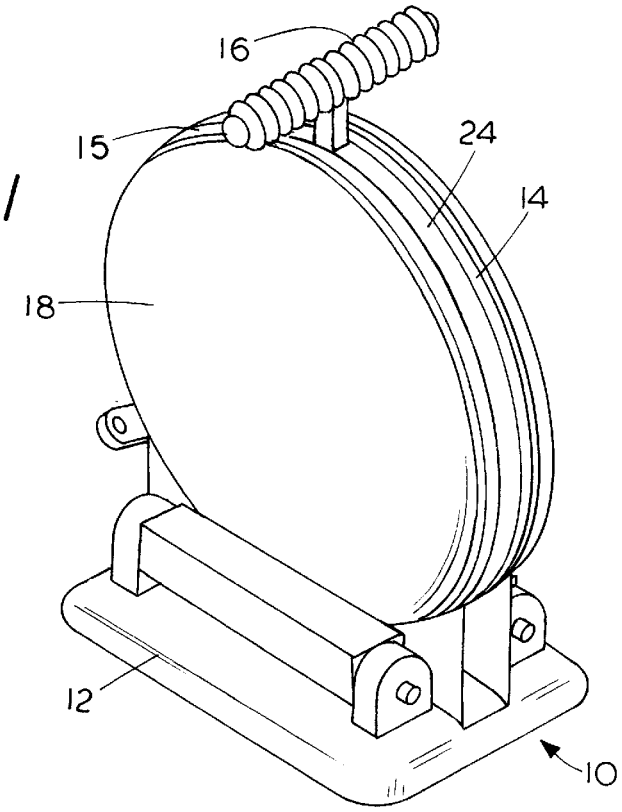
FIG. 1 is an overall perspective view of the bagel slicer
Figure 2:
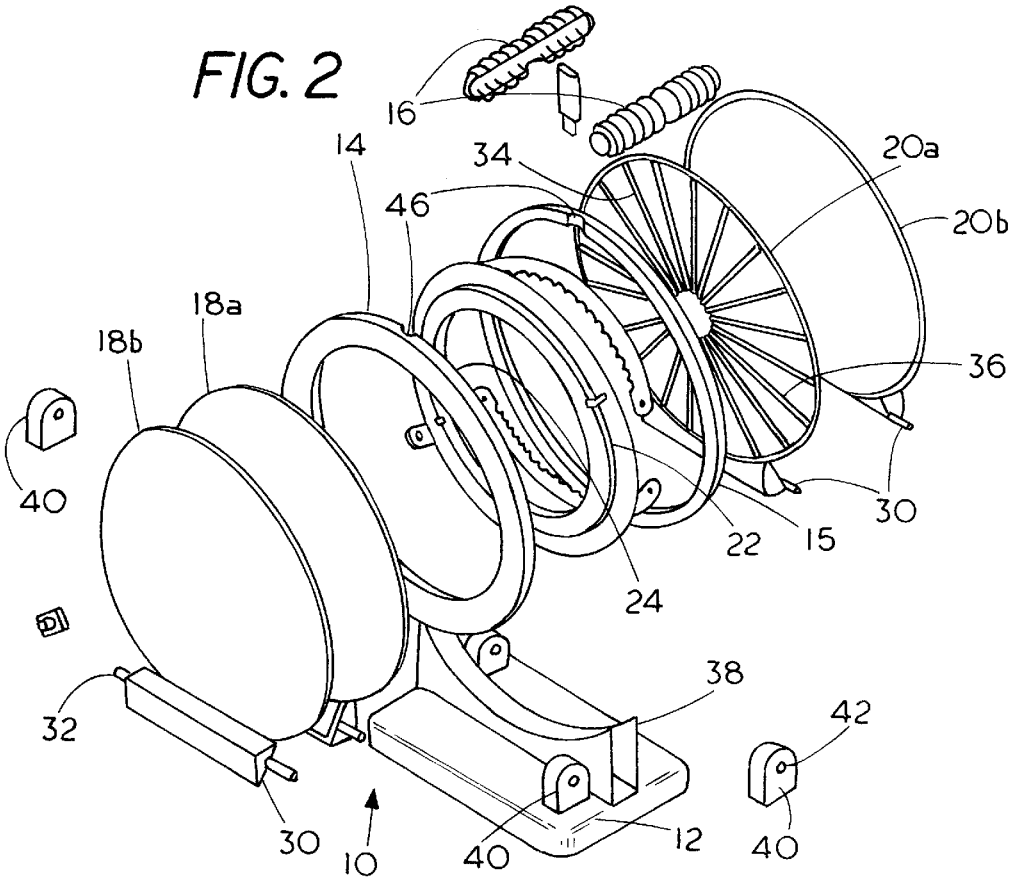
FIG. 2 is an exploded view of the bagel slicer, substantially of FIG. 1.
Figure 3:
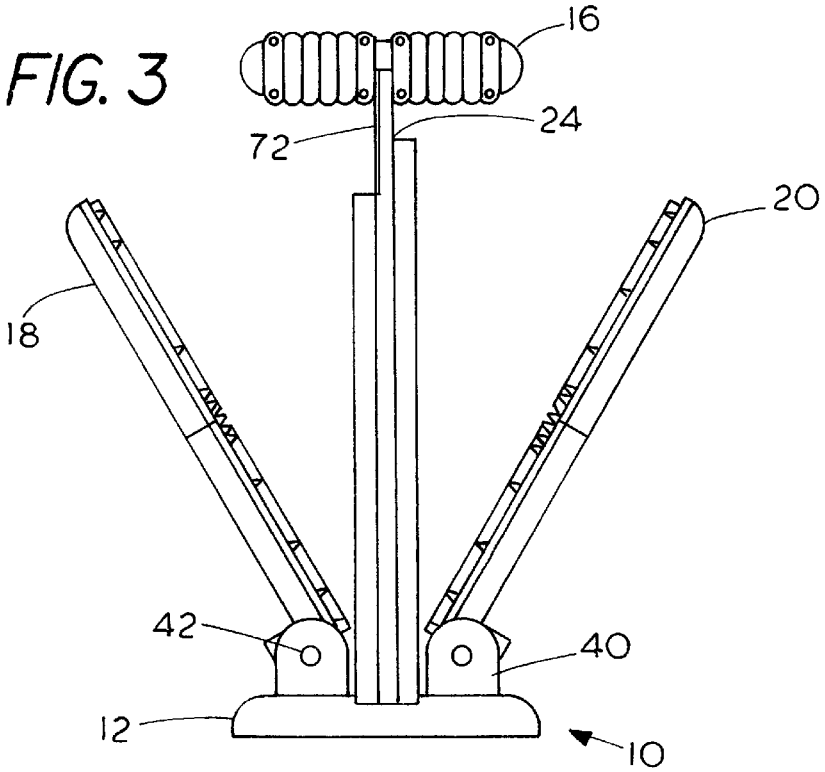
FIG. 3 is an end elevation view of the bagel slicer showing the covers in a partially open position.

The bagel slicer 10, as shown in FIG. 1, consists of a base 12 a bifurcated central annular shaped housing consisting of left annulus 14 and a right annulus 15, an attached handle 16, and a left and a right of cover 18, 20 respectively. The handle 16 is attached to an inner annulus 22 which is fitted inside the central housing 14. A handle slot 24 is formed in the periphery of the annuli 14, 15. The handle 16 passes through the handle slot 24 and is attached to the inner annulus 22. An upper knife 26 is pivotally attached at a first end to the internally to one or the annuli 14 or 15 and similarity the lower knife 28 is pivotally attached at a first end internally to one or the annuli 15 or 14. The second ends of the knives 26, 28 are attached to the inner annulus 22.

The covers 18, 20 are generally circular in shape and have an attachment tab 30 formed extending outwardly from the lower edge. The attachment tab 30 allows the covers 18, 20 to be attached to the base 12. The attachment tabs 30 also have a pivotal attachment means formed therein, the attachment means may be any suitable mechanism to provide pivotal attachment with the base 12 and preferably is a tangential pivot pin 32.

Each cover 18, 20 is preferably bifurcated into an inner cover 18*a,* 20*a* and an outer cover 18*b,* 20*b*. The inner covers 18*a,* 20*a* and outer covers 18*b,* 20*b* are formed having matable edges that are joined together using any suitable means, such as, fasteners, adhesives, fusing, or welding. The inner covers 18*a,* 20*a* have a concave inner surface 34 shaped to approximate the face of a bagel. The inner faces 34 further may have a multiplicity of radial ridges 36 or radial grooves (not shown) formed thereon to assist in gripping the food item to be placed therein and modify the stiffness of the inner face 34.

The inner covers 18*a,* 20*a* may be fabricated to be somewhat flexible so as when pressed against the surface of a food item, some deformation occurs to better grip the food item and to accommodate irregularities in the shape of the food item.

The outer covers 18*b,* 20*b* are fabricated having a convex outer surface. The convexivity of the outer covers 18*b,* 20*b* need only be sufficient to contain the concavity of the inner covers 18*a,* 20*a* and a small additional space allowing for deformation of the inner covers 18*a,* 20*a* and manufacturing tolerances. The outer surface of the outer covers 18*b,* 20*b* may be a plain unadorned surface or may be embossed, or otherwise patterned. It may be advantageous in some embodiments of the bagel slicer 10 to form ribs, grooves, or other stiffening members in the outer covers 18*a,* 20*a* to allow the use of a thinner or more flexible material for fabrication of the outer covers 18*a,* 20*a*. Alternately, decorative ornamentation may be formed on the surface of the outer covers 18*b,* 20*b*.

Each cover 18 or 20 may be formed from any suitable material, such as metal, polymers, or even wood. The cover material should have the properties of sufficient rigidity to maintain its shape while being somewhat deformable and being inexpensive and simple to fabricate. It is preferred that the covers 18, 20 formed from a polymer such as polycarbonate.

The base 12 is generally rectangular in shape having a flat base for placement on a conventional work surface. Along the longer dimension of the base 12 is an attachment block 38 which provides for the attachment of the annuli 14, 15. At approximately each corner of the rectangular base 12 are located the hinge blocks 40. The hinge blocks 40 are located to receive the pivot pins 32 and have a pivot hole 42 formed therein to receive the pivot pins. The hinge blocks may be of any suitable shape, and are preferably formed in the shape of a rounded rectangle having all edges rounded over or chamfered to minimize the risk of the user inadvertently catching clothing or other injuring themselves or moving the bagel slicer from the work surface.

The hinge blocks 40 receive the pivot pins 32 of the respective covers 18, 20 and pivotally retain the covers 18, 20 in the desired location. While is shown with the pivot pins 32 formed integrally extending outwardly from the covers 18, 20, and the pivot holes 42 formed in the hinge blocks 40, it is understood that pivot pins 32 may be formed on hinge blocks 40 and the pivot holes 42 formed on the covers 18, 20. Alternately, the pivot pins 32 can be forgone and replaced with holes so that the pivotal joint is formed using a hinge pin.

While the covers 18, 20 may be allowed to merely pivot open and closed so that the user must hold the covers 18, 20 closed while slicing a food item, it is preferred that a spring means be provided to hold the covers 18, 20 in the closed, vertical position. In one example of a spring means, a torsion spring is placed around one of the pivot pins 32 and biased between the base 12 and a cover 18, 20 so as to urge the cover into a closed position. In the preferred example, an elastic cord is run from one cover 18 through the inner annulus 22 and thence to the other cover 20, so that the rotation of the inner annulus 22 pulls the elastic cord thereby urging the covers 18, 20 to a closed position.

The base 12 and the hinge blocks 40 may be constructed from any suitable material having the properties of being readily formable into the desired shapes, having sufficient strength, and being "food safe." Suitable materials would include most non-flexible polymers, metals, and close grained wood. The preferred material is a polycarbonate plastic which satisfies the aforementioned criteria and additionally is aesthetically pleasing and easy to clean.

The left annulus 14 and the right annulus 15 are a pair of mirror image annular rings having the inner faces sized to mate together. A portion of the periphery of the mating faces of the annuli 14, 15 is absent so that when the annuli 14, 15 are assembled a handle slot 46 is formed to allow the passage of the handle 16 therethrough for movement of the inner annulus 22. The joined annuli 14, 15 are attached to the attachment block 38 using any suitable attachment method, such as fasteners, adhesion, or welding.

The right annulus 15 a pair of first pivot slots 48 located on a diameter on opposite sides of the right annulus 15. A pair of guide ramps 50 are located counter clockwise from and adjacent to the first pivot slots 48.

The annuli 14, 15 may be constructed from any suitable material having the properties of being readily formable into the desired shapes, having sufficient strength, and being "food safe." Suitable materials would include most non-flexible polymers, metals, and close grained wood. The preferred material is a polycarbonate plastic which satisfies the aforementioned criteria and additionally is aesthetically pleasing and easy to clean.

The upper knife 26 and lower knife 28 are a pair of knives 26, 28 that are arcuate in shape and have a smooth, rounded outer surface 52 and a sharpened inner surface 54. The radius of the arc of the outer surface 52 of the knives 26, 28 is sized to fit within the right annulus 15. The radius of the arc of the inner surface 54 of the knives 26, 28 is slightly smaller that the arc of the outer surface 52 of the knives 26, 28. The difference in radii is only sufficient to provide sufficient strength in the knives 26, 28 to prevent deformation and breakage. In addition, the difference in radii of the surfaces 52, 54 of the knives 26, 28 cannot be so great as to have the inner surface of the knives 26, 28, to intrude into the central space of the annuli 14, 15 and prevent the insertion of a food item.

The inner surface 54 of the knives 26, 28 is sharpened to a knife edge for cutting the food item. While the inner surface 54 of the knives 26, 28 may be smooth, it is preferred that serrations 56 be formed on the inner surface 54 to assist with cutting the food item.

The knives 26, 28 also each have a first pivot pin 58 located on a respective first end 60 extending outwardly in a first direction form the plane of each knife 26, 28. A second pivot pin 62 located at the second end 64 of each knife 26, 28. The second pivot pins 62 also extend outwardly from the plane of the knives 26, 28, but, extend in a direction opposite to the first pivot pins 58. The first pivot pins are located and sized for fitment into the first pivot slots 48 of the right annulus 15.

The knives 26, 28 may be fabricated from any suitable material, such as a metal, glass, metal alloy, or a limited group of hard rigid polymers. The preferred material is a ferrous alloy such as stainless steel which has the properties of being stiff, strong, and can be sharpened to a sharp cutting edge and, additionally, is easily cleaned and does not stain with use.

The inner annulus 22 is ring shaped and sized so that the outer surface 66 is a rotatably fit within the left and right annuli 14, 15. The inner surface 68 is sized to allow the inner annulus 22 to surround a food item. The inner annulus also has a pair of second pivot slots 70 formed along a diameter of the inner annulus 22. The second pivot slots 70 are sized and located to receive the second pivot pins 62 of the knives 14, 15.

A handle lever 72 is affixed to the periphery of the inner annulus and extends radially outward therefrom. The handle 16 is attached to the terminal end of the handle lever 72. The handle lever 72 is sized to fit within the handle slot 46 between the left and right annuli 14, 15 to allow the movement of the handle 16, and thence the inner annulus 22 through an arc.

The inner annulus 22 and handle assembly 16, 72 may be constructed from any suitable material having the properties of being readily formable into the desired shapes, having sufficient strength, and being "food safe." Suitable materials would include most non-flexible polymers, metals, and close grained wood. The preferred material is a polycarbonate plastic which satisfies the aforementioned criteria and additionally is aesthetically pleasing and easy to clean.

Figure 4:
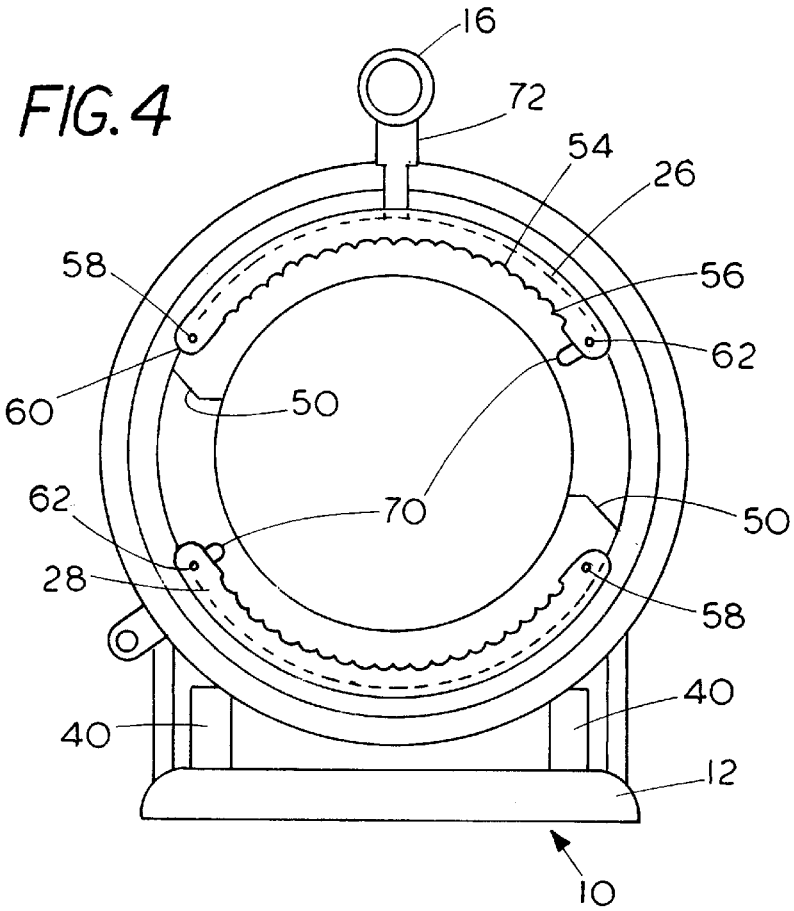
FIG. 4 is a side elevation view of the bagel slicer with the cover removed showing the knives in the open position.
Figure 5:
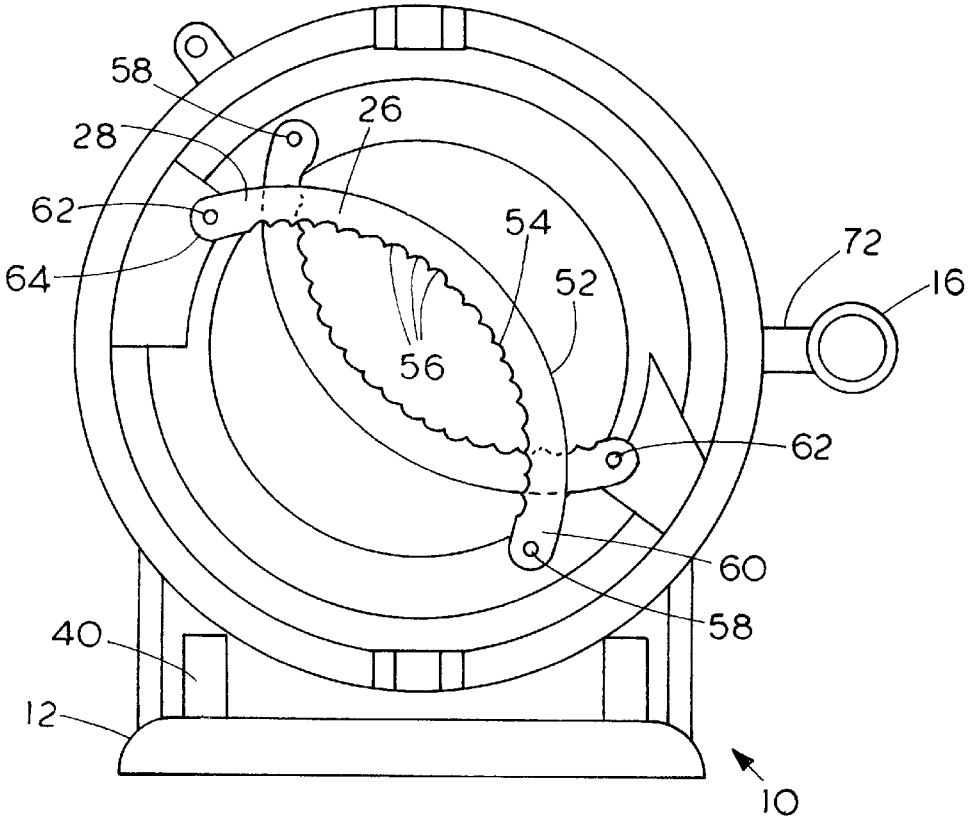
FIG. 5 is a side elevation view of the bagel slicer with the cover removed showing the knives in the closed position.
Figure 6:
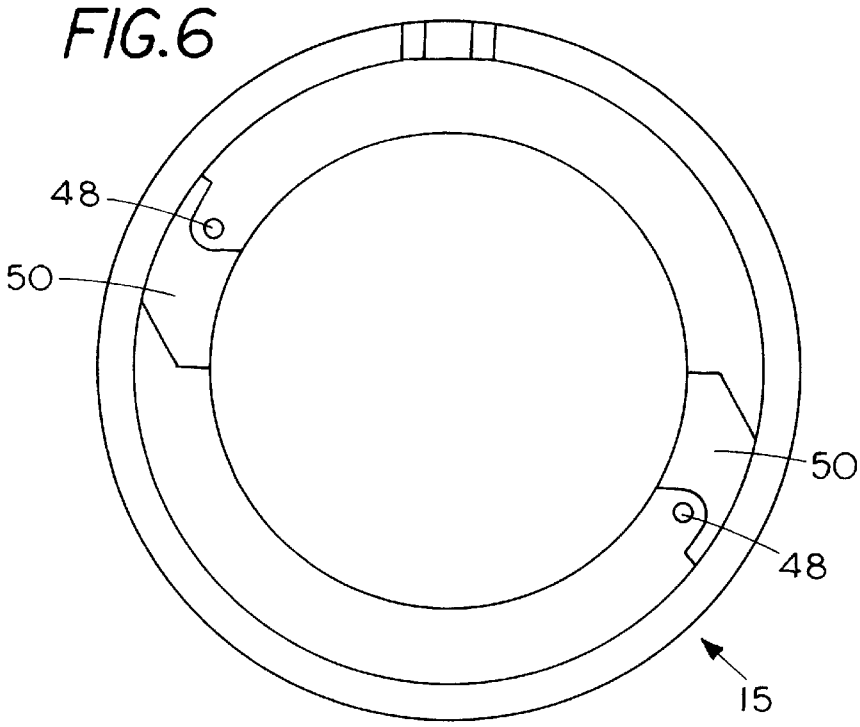
FIG. 6 is a plan view of the right annulus.
Figure 7:
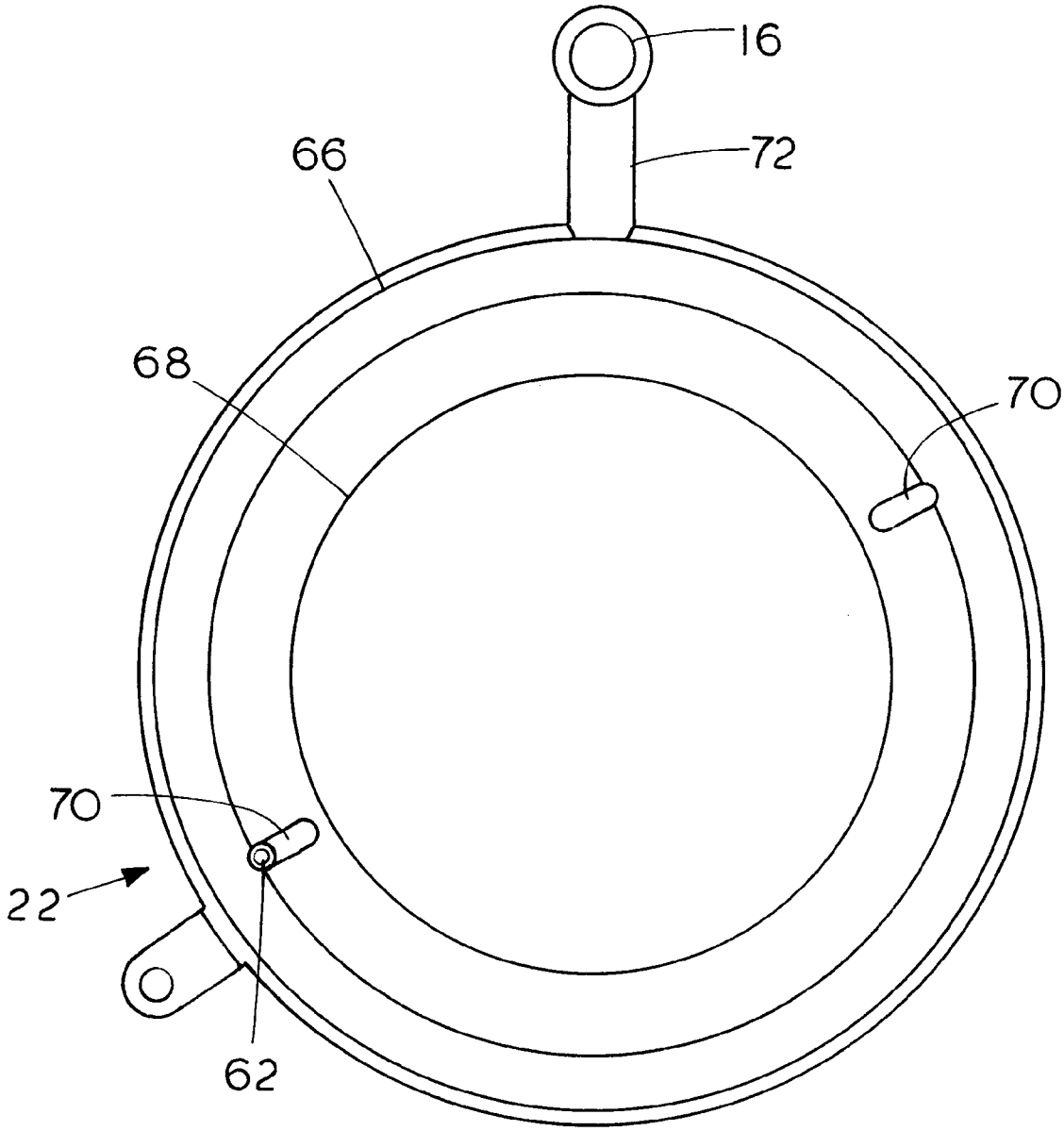
FIG. 7 is a plan view of the inner annulus and handle assembly.

In its use, a user places the bagel slicer 10 on a work surface and places the handle 16 in the position as shown in FIG. 4 to move the knives 26, 28 to an open position. The user then selects a food item for slicing, one or both of the covers 18, 20 is opened and the food item inserted into the round central opening of the bagel slicer 10. The covers are closed and gently held in a closed position. The user then moves the handle 16 of the bagel slicer 10 through an arc to the position as shown in FIG. 5 which rotates the inner annulus 22 through a like arc and causes the knives 26, 28 to move to the closed position, as shown in FIG. 5, slicing through the food item.

With the food item now sliced into two approximate halves, the halves may be removed and, if desired further processed, such as being toasted or a variety of spreads, such as butter, jam, or cream cheese be spread on the food item halves. As thusly prepared the food item may be consumed.

If the user desires another food item, the process is repeated until done. After the meal is consumed, the bagel slicer 10 may be cleaned, if necessary, in soap and water using conventional cleaning agents and returned to a storage location.

Although the present invention has been described with reference to preferred embodiments, workers skilled in the art will recognize changes may be made in form and detail without departing from the spirit and scope of the invention.

What is claimed:

1. A slicing apparatus for slicing a food item comprising:

a. a flat bottomed base for placement upon a work surface;

b. a bifurcated outer annulus attached to the base and extending perpendicularly upward from the base, the annulus further having an arcuate slot formed on the peripheral centerline of the annulus; the annulus further having a first pair of diametric opposed knife attachment points formed on the inner surface of the annulus;

c. an inner annulus located within the outer annulus and rotatable thereat, the inner annulus further having a second pair of diametrically opposed knife attachment points and an attached handle extending radially outward passing through the peripheral slot of the outer annulus;

d. a left cover and a right cover, each cover having a convex circular outer surface and a concave circular inner surface, the periphery of the respective inner surfaces sized to matingly abut with the respective sides of the outer annulus, the covers further being pivotally attached to the base;

e. an upper and a lower knife, each knife being arcuate in shape and having a cutting edge on the smaller diameter edge thereof, and further having a first end and a second end, each of the ends having an attachment point; each of the first ends being pivotally attached to a respective knife attachment point of the outer annulus and each of the second ends being pivotally attached to a respective knife attachment point of the inner annulus; whereby, movement of the handle through an arc rotates the inner annulus moving the knifes across the inner open part of the annuli and slices the food item.

2. The invention according to claim 1 wherein the inner annulus further comprises a lever extending radially outward through the slot in the bifurcated outer annulus.

3. The invention as described in claim 1 wherein the concave inner surface of the covers further comprises a multiplicity of radial ridges formed upon the inner cover.

4. The invention as described in claim 1 wherein the concave inner surface of the covers further comprises a multiplicity of radial grooves formed upon the inner cover.

5. The invention as described in claim 1 further comprising a cooperative spring means for urging the covers into a position adjacent the outer annulus.

6. The invention as described in claim 5 wherein the spring means further a torsional spring wound coaxially to the pivot attachment point.

7. The invention as described in claim 5 wherein the spring means further comprising an elastic cord extending from each cover to the inner annulus, whereby rotation of the inner annulus tension the elastic cord which urges the covers to pivot together.

8. The invention as described in claim 1 wherein the covers further comprise a pair of tangentially extending pins extending outwardly from each cover and the base further comprises a quartet of hinge blocks for attached to and extending upwardly from the base the hinge blocks each further having a hole to receive a pin of a respective cover.

9. The invention as described in claim 1 wherein the inner annulus further comprises a pair of guide ramps formed thereon and located counterclockwisely adjacent the knife attachment points; whereby as the inner annulus is rotated the guide ramps cause the normally coplanar knives to offset so that the second end of the upper knife may pass over the first end of the lower knife and the second end of the lower knife may pass over the first end of the upper knife without interference.

10. The invention as described in claim 1 wherein each knife attachment points of each annuli comprises a hole and each pivotal attachment point of each knife comprises a pin extending orthogonally from the face of the knife.

11. The invention as described in claim 1 wherein the outer annulus attachment points comprise holes and the inner annulus attachment points comprise slots and the knife attachment points each comprise a pin extending orthogonally from the surface of the knife.

12. The invention as described in claim 1 wherein the outer annulus attachment points comprise slots and the inner annulus attachment points comprise holes and the knife attachment points each comprise a pin extending orthogonally from the surface of the knife.

13. A slicing apparatus for slicing food items comprising:

a. a rectangular base having a flat bottom and having an attachment block located along the center line of the length of the base, the attachment block further extending upwardly orthogonally from the base, the base further having hinge blocks formed at each corner and extending orthogonally from the base, the hinge blocks also having a pivot hole formed in each hinge block, the pivot holes located parallel to the length of the base;

b. a left and a right bifurcated cover, each cover being approximately circular in shape and having a downwardly extending attachment tab, each attachment tab having a pair of pivot pins extending tangentially outward in opposite directions from the attachment tabs, the pivot pins being sized to fit into the pivot holes of the hinge blocks of the base; each of the covers further having an inner cover and an outer cover, the inner covers having a concave inner surface shaped to substantially mate with the surface of the food item, and the inner covers further having a multiplicity of radial ridges for gripping the food item; the outer covers having a convex outer surface, the covexity being only sufficient to accept the concavity of the inner covers; the inner covers each being attached to a respective outer cover;

c. a bifurcated outer annulus perpendicularly attached to the attachment block of the base, the outer annulus having a left annulus and a right annulus forming a mirror image pair; the annuli having mating peripheral faces joined together, and a portion of the mating faces removed to form a handle slot at the juncture of the left annulus and the right annulus; the right annulus further having a pair of first pivot slots formed on a diameter of the inner surface of the right annulus, and a pair of guide ramps, the guide ramps located counter clockwisely adjacent the first pivot holes;

d. a pair of arcuate knives having an inner edge and an outer edge, each knife having a first end and a second end; the knives further being serrated along the inner edge, and each knife having a first pivot pin located proximate the first end and a second pivot pin located proximate the second end, the first pivot pins extending outwardly from the respective knives in a first direction and the second pivot pins extending outwardly from the respective knives in a second direction, the first pivot pins pivotally located in the first pivot slots of the right annulus;

e. a circular inner annulus sized to rotatably fit within the outer annulus, the inner annulus having a pair of second pivot slots located along a diameter of the inner annulus, the second pivot slots for receiving the second pivot pins of the knives; the inner annulus further having a lever extending tangentially outward therefrom, the lever having a handle located terminally thereon; whereby, pressure on the handle is transferred by the lever to rotate the inner annulus through an arc causing the knives to pivot through an arc thereby slicing the food item into two parts.

* * * * *